United States Patent [19]

Pircher et al.

[11] Patent Number: 4,516,947

[45] Date of Patent: May 14, 1985

[54] DISCOIDAL AMUSEMENT DEVICE

[76] Inventors: Donna S. Pircher; Reinhold A. Pircher, both of 2701 Sioux, Independence, Mo. 64057

[21] Appl. No.: 538,091

[22] Filed: Oct. 3, 1983

[51] Int. Cl.[3] ..... A63H 27/00

[52] U.S. Cl. ..... 446/46

[58] Field of Search ..... 446/46, 47, 48; 273/424, 425, 428; D21/85, 86, 446, 273

[56] References Cited

U.S. PATENT DOCUMENTS

| | | | |
|---|---|---|---|
| D. 211,104 | 5/1968 | Steadman | D21/86 |
| 3,359,678 | 12/1967 | Headrick | 273/424 X |
| 3,571,811 | 3/1971 | Wilson | 273/424 X |
| 3,850,341 | 11/1974 | Bart | D21/86 X |
| 4,086,723 | 5/1978 | Strawick | 273/424 X |
| 4,132,030 | 1/1979 | Lehman | 446/46 |

*Primary Examiner*—Mickey Yu

*Attorney, Agent, or Firm*—Kokjen, Kircher, Bradley, Wharton, Bowman & Johnson

[57] ABSTRACT

A toy saucer having a peripheral fin and ribs for stability and a central air pocket for controlled descent. The saucer has a concavo-convex disc body with a downturned flange on its periphery. The fin is horizontal and projects outwardly from the flange. The ribs are vertical and are spaced apart on the outer surface of the flange beneath the fin. The air pocket is formed by an inverted cup centered on the disk.

5 Claims, 3 Drawing Figures

DISCOIDAL AMUSEMENT DEVICE

BACKGROUND AND SUMMARY OF THE INVENTION

This invention relates generally to discoidal toys and more particularly to a toy disk which exhibits enhanced stability and other improved flight characteristics.

Toy saucers or disks which are thrown and caught and otherwise used in amusement activities have achieved considerable popularity. Although the disks that have been available in the past can be controlled with reasonable accuracy by persons having skill and experience in their use, they are not easily controlled by those who are less proficient. The lack of stability in existing toy disks causes them to abruptly curve and/or dive if they depart from a horizontal position in flight. Consequently, unskilled persons who are unable to throw the disk such that it remains perfectly level are unable to accurately control the distance and direction of flight of the disk. This inability to control the flight of toy saucers discourages beginners and others from taking part in activities involving their use.

The present invention is directed to an improved discoidal toy and has, as its primary goal, the provision of a toy disk or saucer which exhibits more stability in flight and can be controlled more easily than the disks that have been available in the past. In accordance with the invention, a concavo-convex disk body has a downturned flange or skirt on its periphery to provide both a hand grip and an air barrier which retains air beneath the disk body for lift. A flat annular fin is formed on the flange and projects outwardly at a location midway along the height of the flange. The fin improves the aerodynamic properties of the disk and is particularly important in stabilizing its flight because of the ability of the fin to oppose any tendency of the disk to depart from a level flight pattern.

Beneath the stabilizing fin, a series of vertical ribs are formed on the outer surface of the flange. Each rib extends between the fin and the free lower edge of the flange. The ribs serve to further stabilize the flight of the disk and act by themselves and in cooperation with the fin to maintain the disk in a level flight pattern. Together, the fin and rib structure on the peripheral flange of the disk body provide the saucer with a stabilizing influence tending to right it to a horizontal orientation if it begins to deviate from level flight.

As another important feature of the invention, the center of the disk is provided with an inverted cup which enhances the lift and the ability of the disk to gradually descend in a controlled fashion. Concentric rings are formed on the convex top surface of the disk body to further enhance its stability during flight.

The aforementioned features and the overall symmetry result in a toy saucer which can be thrown more accurately and with less tendency to dive and curve abruptly than currently available saucers. Any tendency for the disk to deviate from a level flight path is opposed by the fin and rib structure on its periphery, so erratic flight of the disk is greatly reduced. At the same time, the disk descends in a gradual manner due largely to the central air pocket provided by the inverted cup. Consequently, the disk can be thrown more accurately and caught more easily than existing disks, and its appeal to beginners and other unskilled persons is enhanced accordingly.

DETAILED DESCRIPTION OF THE INVENTION

In the accompanying drawing which forms a part of the specification and is to be read in conjunction therewith and in which like reference numerals are used to indicate like parts in the various views.

Figure 1:
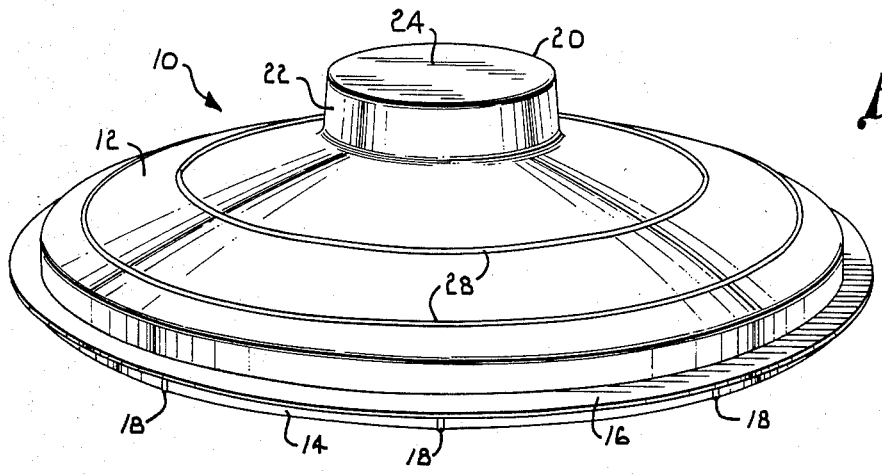
FIG. 1 is a perspective view of a toy saucer constructed in accordance with a preferred embodiment of the present invention.
Figure 2:
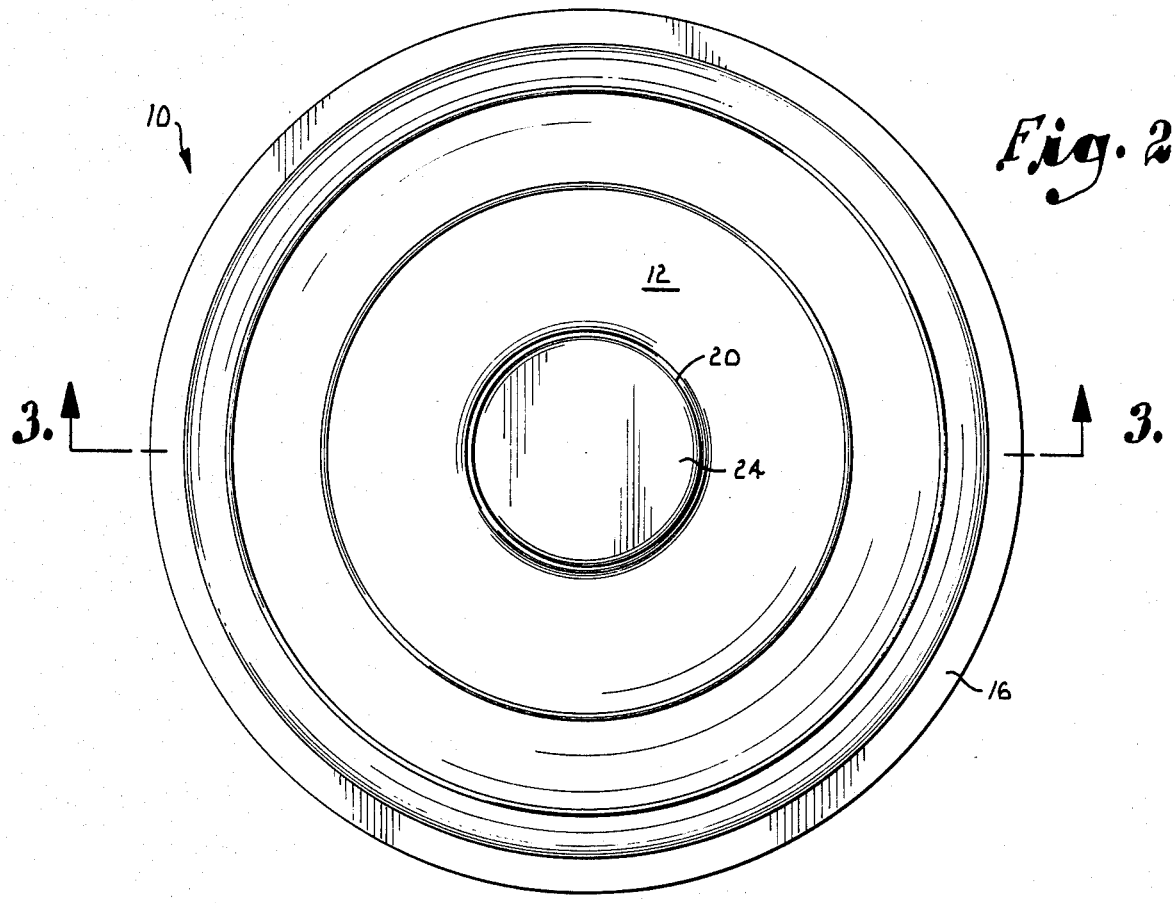
FIG. 2 is a top plan view of the saucer.

Referring now to the drawing in more detail, numeral 10 generally designates a toy disk or saucer constructed according to the present invention. The saucer 10 has a discoidal body 12 which is concavo-convex. The top side of the body 12 is a convex surface, and the bottom side of the body is concave in order to enhance the aerodynamic lift during flight. Preferably, the entire saucer 10 is moded from a suitable plastic material in a single integral piece.

The disk body 12 has a circular periphery on which a downturned skirt or flange 14 is formed. Flange 14 is cylindrical and has its top edge integrally connected with the periphery of body 12. The lower edge of flange 14 is a free circular edge. The flange 14 provides a hand grip to facilitate throwing and catching of the saucer. The flange also helps to retain air beneath the disk body in order to enhance the lift and stabilize the flight of the disk.

Projecting outwardly from flange 14 is a stabilizing fin 16. The fin 16 extends radially outwardly from the outer surface of flange 14 at a location approximately midway between the upper and lower edges of the flange. Fin 16 is annular in shape and occupies a horizontal plane when the concave side of body 12 faces downwardly in flight. The outer edge of fin 16 is a free circular edge.

Figure 3:
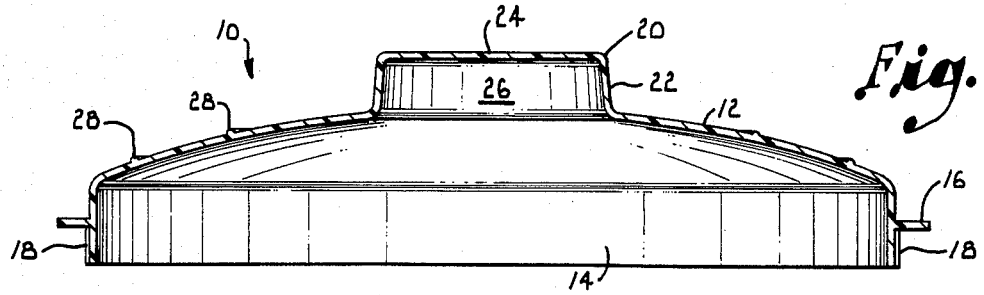
FIG. 3 is a sectional view taken generally along line 3—3 of FIG. 2 in the direction of the arrows.

Below the fin 16, a plurality of stabilizing ribs 18 are formed on flange 14 to assist in stabilizing the flight of the saucer. Each rib 18 is a straight member which extends from the lower surface of fin 16 to the lower free edge of the flange 14. Fins 18 are molded integrally on the outer surface of flange 14 and are spaced equidistantly around the flange. It has been found that eight ribs 18 spaced 45° apart provide the disk with good stability characteristics, although a different number can be employed. Each rib 18 has a vertical orientation when the concave side of the disk faces downwardly in flight, as shown in FIG. 3. Fin 16 projects considerably farther from flange 14 than the ribs 18.

The center of the disk body 12 is provided with an inverted cup 20 which is open at the bottom and closed at the top to retain air. The cup 20 is formed by a cylindrical wall 22 which extends upwardly from the top or convex surface of the disk body. The wall 22 is centered on the disk body. Extending across the top of the wall 22 is a top panel 24 having the shape of a flat, horizontal disk. As best shown in FIG. 3, the cup 20 is open at the bottom and provides an air pocket 26 inside of the wall 22 and below the top panel 24.

Additional stability is provided by a pair of concentric rings 28 which project upwardly from the convex top surface of the disk body 12. The rings 28 are concentric with one another and with the cylindrical wall 22 of cup 24. The outermost ring 28 is spaced inwardly of the periphery of the disk body. The distance between the two rings 28 is greater than the distance between the outer edge of the disk body and the outermost ring but less than the distance between the innermost ring 28 and the wall 22.

In use, the saucer 10 serves as an amusement device which can be thrown and caught by players or otherwise used in amusement activities. The saucer is thrown in the usual manner by grasping its periphery, usually with the thumb located on the upper surface of the disk body and the fingers extending beneath the bottom edge of the flange 14. One of the ribs 18 can be gripped with the index finger to improve the grip. The saucer is caught in the usual manner by grasping its periphery with the hand as it descends.

The direction and distance of the saucer 10 can be controlled more accurately than the toy disks that have been available in the past. The disk should be released such that its orientation is as near horizontal as possible. The air in the air pocket 26 and beneath the disk body within flange 14 provides a lift force which opposes the weight of the disk and maintains it airborne.

If the disk is thrown slightly out of level or begins to depart from a horizontal position during flight, the fin 16 and ribs 18 tend to return it to a horizontal orientation. Although the exact aerodynamic forces involved are not known, it is believed that a departure of the disk from a level flight pattern is resisted because the portion of the fin 16 which dips results in air being trapped beneath such portion of the fin, thereby applying a lift force tending to raise the portion of the fin which dips. The air which provides this lift force is assisted by the adjacent ribs 18 which help to retain it beneath the dipped area of the fin 16. In addition, the air flowing over the ribs 18 exerts a stabilizing force which in itself opposes any tendency for the disk to deviate from a level flight path. The stabilizing fin 16 and stabilizing ribs 18 thus act both by themselves and together in cooperation to stabilize the flight of the saucer. By resisting dipping of the edge of the disk, the fin and rib structure resist the tendency for the disk to abruptly curve to one side and/or dive rapidly as occurs when the edge of a conventional disk toy dips.

The added lift force resulting from the air contained in the air pocket 26 causes the disk to descend in a gradual and controlled manner so that it can be easily caught, even by beginners and other unskilled persons. When the disk loses momentum and thus descends, the air which is contained in the central air pocket 26 maintains the disk in a stable flight condition and thus keeps the disk airborne somewhat longer than would occur in the absence of an air pocket. Consequently, a more gradual descent occurs and catching of the saucer is simplified. Further stability is provided by the concentric rings 26 on the upper surface of the disk.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawing is to be interpreted as illustrative and not in a limiting sense.

Having thus described the invention, we claim:

1. A discoidal toy comprising:

a discoidal body having a convex top side and a concave bottom side and presenting a generally circular periphery;

a cylindrical flange on the periphery of said body providing a hand grip to facilitate throwing and catching of the body, said flange having an outer surface and presenting a free edge and an opposite edge connected with said periphery of the body;

a planar fin projecting outwardly from said flange at a location thereon between said free and opposite edges, said fin being annular and having flat and parallel opposite surfaces and said fin occupying a substantially horizontal plane when said bottom side of the body faces downwardly in flight; and a plurality of ribs on said flange for stabilizing said body in flight, each rib extending only below said fin and having a top end adjacent said fin and a bottom end adjacent said free edge of the flange, said ribs being spaced apart from one another substantially equidistantly on the outer surface of said flange and each rib having a generally vertical orientation when said concave side of the body faces downwardly in flight.

2. A discoidal toy as set forth in claim 1, including:

a center portion of said body; and means providing an air pocket in said center portion of the body on said concave side thereof for receiving air to stabilize the body in flight.

3. A discoidal toy comprising:

a discoidal body presenting a convex top side and a concave bottom side, said body having a generally circular periphery;

an inverted cup projecting from said top side of the body at a substantially centered position thereon, said cup being closed at the top and open at the bottom to provide an air pocket for receiving air to stabilize said body in flight;

a cylindrical flange on the periphery of said body providing a hand grip to facilitate throwing and catching of the body, said flange having an upper edge connected with said periphery and a free lower edge;

an annular fin on said flange projecting outwardly therefrom at a location intermediate said upper and lower edges, said fin being a planar member with flat upper and lower surfaces parallel to one another and said fin occupying a substantially horizontal plane when said bottom side of the body faces downwardly in flight; and a plurality of ribs on said flange spaced substantially equidistantly apart in outward projection from the flange, each rib extending only from said fin to said free lower edge of the flange and not above the fin and each rib being a substantially straight member having a vertical orientation when said bottom side of the body faces downwardly in flight.

4. A discoidal toy as set forth in claim 3, wherein said cup includes:

a cylindrical wall projecting from said top side of the body; and a top panel extending across the top of said wall, said air pocket being presented within said wall and below said top panel.

5. A discoidal toy as set forth in claim 4, wherein said top panel has the form of a flat disk.

* * * * *